United States Patent [19]

Lenormand et al.

[11] Patent Number: 5,039,992

[45] Date of Patent: Aug. 13, 1991

[54] HIGH TEMPERATURE SKIN ANTENNA

[75] Inventors: Régis Lenormand, Blagnac; Michel Coustere, Saint Germain en Laye; Gérard Raguenet, Portet Sur Garonne; Olivier Remondiere, Frouzins, all of France

[73] Assignee: Alcatel Espace, Courbevoie, France

[21] Appl. No.: 526,755

[22] Filed: May 22, 1990

[30] Foreign Application Priority Data

May 24, 1989 [FR] France ..... 89 06782

[51] Int. Cl.[5] ..... H01Q 1/280; H01Q 1/380; H01Q 13/080

[52] U.S. Cl. ..... 343/708; 343/700 MS; 343/705

[58] Field of Search ..... 343/700 MS, 705, 708, 343/873, 878, 767, 789

[56] References Cited

U.S. PATENT DOCUMENTS

| | | | |
|---|---|---|---|
| 4,197,544 | 4/1980 | Kaloi | 343/700 MS |
| 4,675,685 | 6/1987 | Finken | 343/708 |
| 4,709,240 | 11/1987 | Bordenave | 343/705 |
| 4,843,400 | 6/1989 | Tsao et al. | 343/700 MS |
| 4,857,938 | 8/1989 | Tsukamoto et al. | 343/700 MS |

FOREIGN PATENT DOCUMENTS

| | | | |
|---|---|---|---|
| 2166907 | 5/1986 | United Kingdom | 343/700 MS |

OTHER PUBLICATIONS

1983 International Symposium Digest Antennas and Propagation, Houston, Tex., 1983, vol. 2, pp. 350-352, IEEE, New York, U.S.; W. S. Gregorwich: "The Space Shuttle Tile: A New Electronic Substrate and Radome Material".

L'Onde Electrique, vol. 69, No. 2, Mar./Apr. 1989, pp. 15-21, Paris, France; A. Papiernik: "Les Activites du Groupement de Recherche Microantennes du CNRS".

Third International Conference on Antennas and Propagation—ICAP '83, 12-15, Apr. 1983, part 1: Antennas, pp. 309-312, K. G. Verma et al., "Triplate Feed for Microstrip Arrays".

IEEE Transactions on Communications, vol. COM-26, No. 11, Nov. 1978, pp. 1713-1722, IEEE, New York, U.S.; H. D. Cubley et al.: "Antenna Development for the Space Shuttle Orbiter Vehicle".

*Primary Examiner*—Michael C. Wimer
*Assistant Examiner*—Peter Toby Brown
*Attorney, Agent, or Firm*—Sughrue, Mion, Zinn, Macpeak & Seas

[57] ABSTRACT

The invention relates to a space reentry vehicle high-temperature skin antenna comprising a printed antenna embedded in a tile for providing thermal protection, and fed by electromagnetic coupling. The invention is particularly applicable to space telecommunications.

3 Claims, 2 Drawing Sheets

HIGH TEMPERATURE SKIN ANTENNA

The invention relates to a high temperature skin antenna.

BACKGROUND OF THE INVENTION

A skin antenna needs to be compatible with the aerodynamic and thermal stresses to which the vehicle on which it is mounted is subjected.

For a space reentry aircraft, reentry into the atmosphere leads to temperatures exceeding 1,000° C., while the internal structure of the aircraft cannot exceed a temperature of about 150° C. This problem may be solved by using thermal protection of the type comprising alumina felt having a thickness of approximately 15 cm. The thermal protection must be maintained on the outside of the aircraft, but aerodynamic stress requires an outer envelope having a good surface state. In order to solve this problem, a structure may be proposed comprising an external tile whose function is to provide thermal protection while guaranteeing a good surface state for aerodynamic properties of the outer envelope of the aircraft.

The object of the invention is to provide a skin antenna compatible with this type of protection and which facilitates provision of interfaces between the thermal protection and the aircraft inside.

SUMMARY OF THE INVENTION

To this end, the present invention provides a high temperature skin antenna comprising at least one plated radiating element placed in a cavity on the surface of a layer of dielectric material, said cavity being made in the continuity of a thermal protection tile, the bottom of the cavity constituting the ground plane for the radiating element.

BRIEF DESCRIPTION OF THE DRAWINGS

An embodiment of the invention is described by way of example with reference to the accompanying drawings, in which.

DETAILED DESCRIPTION

Figure 1:
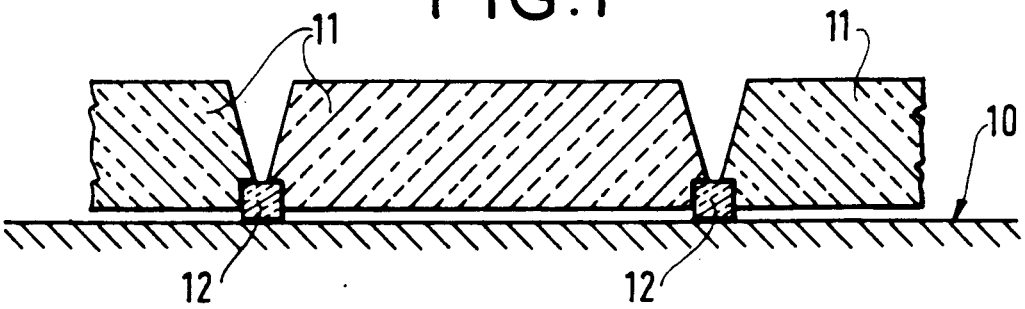
FIG. 1 is a diagram illustrting prior art thermal protection.

As shown in FIG. 1, thermal protection for a space reentry aircraft 10, for example, is provided by means of tiles 11. These tiles 11 are held on the exterior surface of aircraft 10 by means of spacers 12 which provide thermal decoupling. The high temperatures, exceeding 1,000° C., lead to the use of composite carbon materials.

Figure 2:
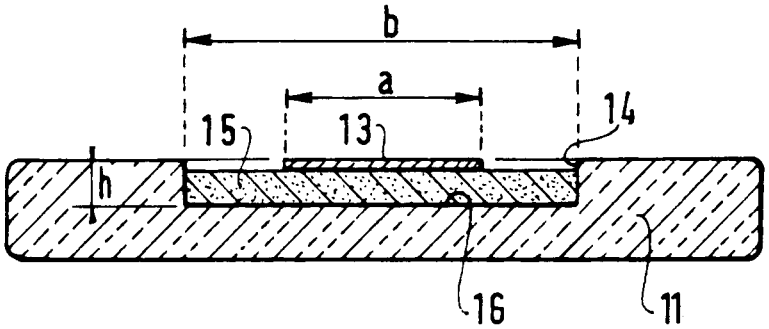
FIGS. 2 to 5 are diagrams illustrating different aspects of an antenna of the invention.
Figure 3:
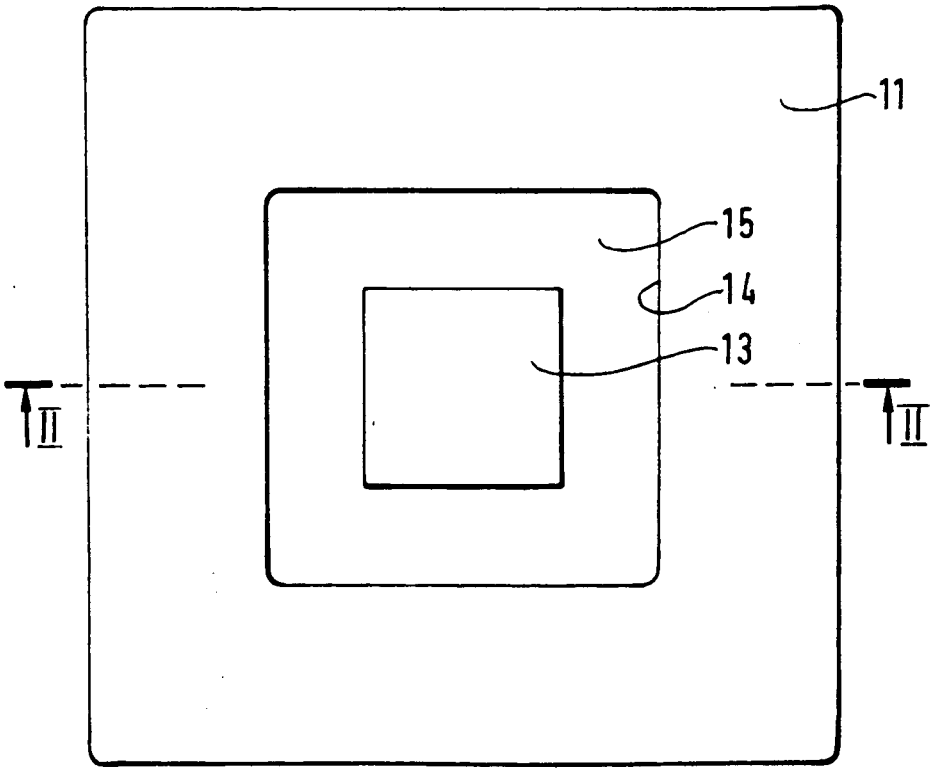

As shown in FIGS. 2 and 3, which are respectively a section view and a plan view of an antenna of the invention, the antenna consists in using a plated radiating element 13 placed in a cavity or recess 14 in the outer face of a tile 11. Since the tile material contains a large fraction of carbon it may be considered as being a conductor with respect to microwaves. Thus, the bottom 16 of the cavity 14 constitutes the ground plane for the radiating element 13. The cavity 14 is filled with a high temperature dielectric material 15. The radiating element 13 of the antenna is made using a conductive material which is likewise compatible with high temperatures (e.g. a composite, tungsten, . . . ).

The person skilled in the art knows how to assemble these various materials.

By way of numerical example, for a frequency of 2 GHz, and assuming the dielectric 15 to have a constant $E_r \approx 3$, the cavity and the radiating element or "patch" could have the following dimensions:

$$h \approx 3 \text{ mm}, a \approx 35 \text{ mm}, b \approx 100 \text{ mm},$$

where h is the depth or thickness of the recess or cavity 14.

Because of the constraints related to the antenna being dismountable, the invention proposes compatibility in this type of skin antenna between the mechanical and electrical interfaces: one of the spacers 12 for fixing the tile 11 serves to position the electromagnetic coupling slot which serves as the electrical interface with the aircraft.

Figure 4:
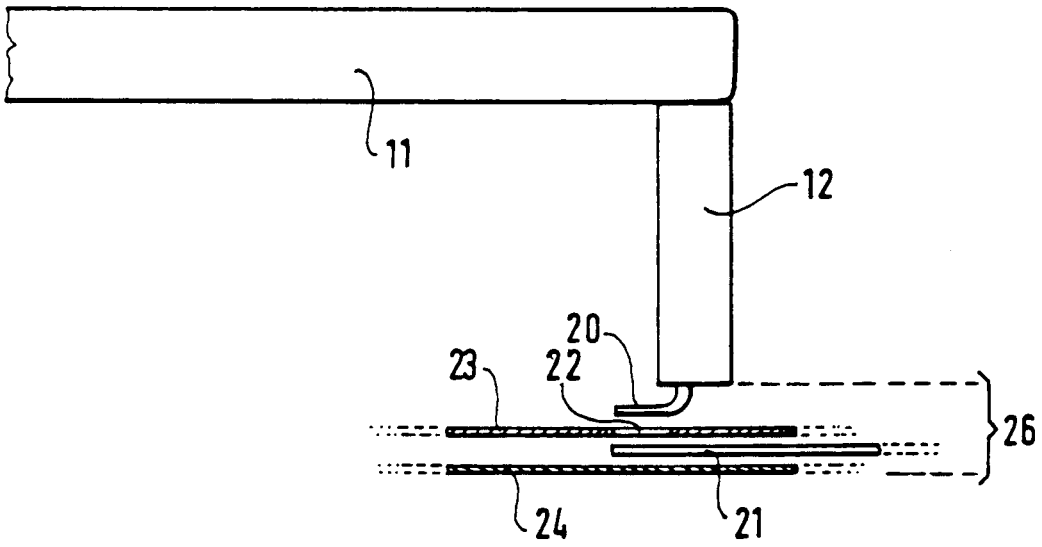

As shown in FIG. 4, the central core 20 of the antenna feed conductor or "feeder" and the central core 21 of the conductor inside the aircraft are coupled via a slot 22. FIG. 4 shows the tile 11, the corresponding fixing spacer 12, and the "cold" structure 23 of the aircraft together with the ground plane 24.

This coupling may be of the capacitive type. In order to ensure continuity of the inside skin of the aircraft, the slot 22 may be made of dielectric material.

As a result, the electrical interface is designed to be disassembled. It imposes no positioning constraints other than the accuracy of the mechanical interface between the tile and the aircraft. In theory, it does not convey an additional flow of heat to the skin of the aircraft.

The antenna feeder provides the electrical connection between the electrical interface and the antenna. It is made using substantially the same principles as are used for making the radiating element.

Figure 5:
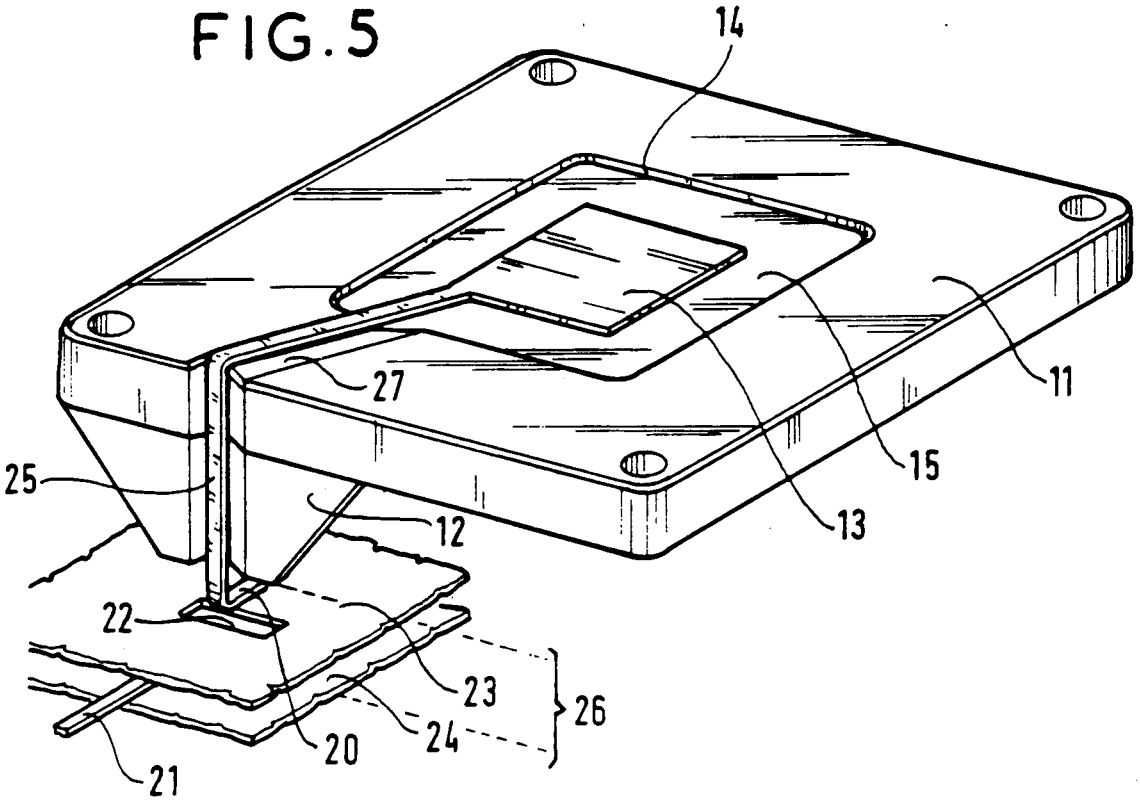

In the embodiment shown in FIG. 5, there can be seen the tile 11 fitted with a cavity or recess 14 within the outer face of the title, containing a slab 15 of dielectric with the radiating element 13 being disposed on the outer face of the slab 15. The tile 11 may be fixed to the space reentry aircraft by means of four spacers, with one of them (as shown) containing the feeder 25 for the radiating element 13. The feeder 25 may be constituted, for example, by a microstrip transmission line or central conductor made on a material analogous to that of the dielectric 15, or else by a three-plate transmission line or a coaxial transmiission line. 26 designates the coupling via the electromagnetic slot as already illustrated in FIG. 4.

In FIG. 5, the tile 11 has a fillet 27 equivalent to a half waveguide over the entire length of the connection between the antenna and the electrical interface. This waveguide is filled with dielectric 15 and the central conductor of the feeder 25 is made of high temperature material.

The dielectric 15 may be subjected to surface treatment.

The tile 11 may be covered by a protective layer (radome) which is different in nature from the dielectric 15.

Naturally, the present invention has been described and shown merely by way of preferred example, and its component parts could be replaced by equivalent parts without thereby going beyond the scope of the invention.

We claim:

1. A skin antenna mounted to the exterior surface of a space reentry vehicle, said space reentry vehicle comprising a plurality of thermal protection tiles of a material subjected to vehicle external reentry temperatures exceedng 1,000° C., with each tile fixed to said vehicle by a plurality of spacers providing thermal decoupling, said vehicle including an inside conductor, said antenna comprising at least one of said tiles being formed of a material capable of functioning as a conductor of microwaves, a recess formed within an outwardly facing surface of said at least one tile, a slab of dielectric material contained within said recess, a radiating element being disposed on an outwardly facing surface of said dielectric material slab, the bottom of said recess constituting a gound plane of said radiating element, said dielectric material and said radiating element being formed respectively of materials capable of withstanding said reentry temperatures, and a microwave feed line contained in one of said spacers of said at least one tile, said microwave feed line being connected to said radiating element and being coupled to said vehicle inside conductor via an electromagnetic slot.

2. An antenna according to claim 1, wherein the outwardly facing surface of the slab of dielectric material is surface treated.

3. An antenna according to claim 1, further including a protective layer on said slab of dielectric material of a material different from that of the slab.

* * * * *